United States Patent [19]

Schlesinger et al.

[11] 4,129,916

[45] Dec. 19, 1978

[54] ADJUSTABLE SKATEBOARD RAMP

[76] Inventors: Todd R. Schlesinger, 147-½ Virginia Pl., Costa Mesa, Calif. 92627; William L. Shaffer, 3235 Nebraska St., Costa Mesa, Calif. 92626

[21] Appl. No.: 890,454

[22] Filed: Mar. 27, 1978

[51] Int. Cl.[2] ..... E01D 1/00

[52] U.S. Cl. ..... 14/69.5; 211/182; 404/1; 182/165; 52/282; 40/152.1; 248/441 R

[58] Field of Search ..... 14/1, 69.5; 182/130, 182/152, 165; 211/182, 189, 195; 404/1; 52/282; 40/152.1; 248/454, 448, 441 R

[56] References Cited

U.S. PATENT DOCUMENTS

| | | | |
|---|---|---|---|
| 255,215 | 3/1882 | Tuttle | 211/195 |
| 398,027 | 2/1889 | Casler | 211/182 X |
| 1,095,045 | 4/1914 | Timberlake | 211/195 |
| 2,466,149 | 4/1949 | Burg | 211/182 X |
| 2,607,937 | 8/1952 | Stone | 14/69.5 |
| 2,969,607 | 1/1961 | Grumbacher | 248/448 X |
| 3,330,524 | 7/1967 | Foley | 248/441 R |
| 3,341,028 | 9/1967 | Nichols | 211/182 X |
| 3,861,695 | 1/1975 | Shourek | 211/195 X |

*Primary Examiner*—Nile C. Byers, Jr.
*Attorney, Agent, or Firm*—Mahoney, Schick & Cislo

[57] ABSTRACT

An adjustable ramp includes a ramp member supported in an adjustable suspensory frame. Adjustment of the suspensory frame changes the angle of incidence of the ramp member to the supporting surface on which the ramp is located. A resilient ramp member is provided in one embodiment which is maintained in curvilinear, flexed attitude on the supporting frame by the moveable connections of said ramp member to said suspensory frame.

11 Claims, 14 Drawing Figures

ADJUSTABLE SKATEBOARD RAMP

BACKGROUND OF THE INVENTION

Skateboards, rollerskates and similar wheeled sporting devices were originally developed and utilized on relatively planar surfaces by the initial users thereof. However, as is well known to those skilled in the art, devotees of skateboarding and rollerskating attain such high degrees of skill that they are not satisfied with the exercise of their skills on horizontal surfaces but have resorted to the utilization of curvilinear, inclined surfaces such as the curvilinear surfaces of swimming pools and the like.

As a matter of fact, recently, parks devoted to providing complicated maneuvering surfaces for skateboard devotees have been built in various parts of the United States and skilled skateboarders can disport themselves upon the curvilinear and elevated surfaces in a variety of gymnastic maneuvers equaling, if not excelling, the various acrobatic skills with which skiers customarily exhibit their expertise.

Of course, the parks mentioned hereinabove are costly and are usually located in areas of the United States where they can be built outdoors and not subjected to excessively inclement weather. In addition, the parks are designed for use by skateboarders and riders of other wheeled sporting devices, such as rollerskates, who have achieved a considerable degree of skill in the manipulation of those devices. Consequently, they are hardly suitable for utilization by a novice who has not sufficiently advanced in the art to be able to cope with the intricacies of their curves and convolutions.

Furthermore, at the present time, there are few such parks and, as mentioned hereinabove, they are not oriented to novice skills.

OBJECTS AND ADVANTAGES OF THE INVENTION

Since the larger number of skateboarders and rollerskaters are juveniles, there has been a pressing need for a device which would facilitate the progressive development of manipulative skills which would insure against the dangerous and premature exposure of such juveniles to the possible hazards of sophisticated skateboard parks and like.

It is, therefore, an object of our invention to provide a skateboard ramp which will facilitate the acquisition by young practitioners of the skateboard and rollerskating arts of the necessary manipulative skills in a progressive manner so that the possibility of injuries incurred by premature exposure of such individuals to difficult environments will be eliminated.

Another object of our invention is the provision of a skateboard ramp which provides an adjustable ramp member which is adapted to be adjusted into various angles of incidence to a supporting surface so that, as the skill of an individual utilizing the ramp increases, the angle of the ramp member with respect to the supporting surface can be correspondingly increased with the result that the skills of the individuals utilizing the ramp can be gradually perfected.

An additional object of the invention is the provision of a ramp of the aforementioned character in which the ramp member is elongated and curvilinear and is supported on a suspensory frame which rests upon a supporting surface. The suspensory frame incorporates adjustment means which permits the adjustment of the ramp member concomitantly with the adjustment of the suspensory frame so that the angle of incidence of the ramp member with respect to the surface on which the frame is supported may be altered to permit different maneuvers and individuals of different skills to utilize the ramp to the fullest extent possible. A further object of our invention is the provision of a ramp of the aforementioned character whose components may be readily separated from operative relationship with each other and as easily reassembled to facilitate, in the former instance, the shipment of the ramp and, in the latter instance, to permit the easy assembly of the components.

An additional object of the invention is the provision of a ramp of the aforementioned character wherein connecting means are interposed between the ramp member and the suspensory frame to facilitate relative movement between the ramp member and the suspensory frame during adjustment of said suspensory frame and alteration of the angle of incidence of said ramp member with respect to the aforesaid supporting surface.

Another object of the invention is the provision of a ramp which includes a ramp member fabricated from a flexible or resilient material and wherein the ramp member is so mounted in the suspensory frame as to assume a curvilinear aspect which will vary in its arcuity as the ramp member is adjusted concomitantly with the adjustment of the suspensory frame.

An additional object of the invention is the provision of a ramp incorporating the aforesaid flexible, resilient ramp member which includes auxiliary support means adapted to be utilized in conjunction with said resilient ramp member to limit the deflection of said ramp member under load.

Another object of the invention is the provision of a ramp incorporating a flexible, resilient ramp member in which the aforesaid auxiliary support is adjustable upon the suspensory frame to accommodate alterations in the curvilinear aspect of said member.

Other objects and advantages of the invention will be apparent from the drawings, which are described hereinbelow, and the accompanying specifications and claims.

DETAILED DESCRIPTION OF THE PREFERRED EMBODIMENTS OF THE INVENTION

Figure 1:
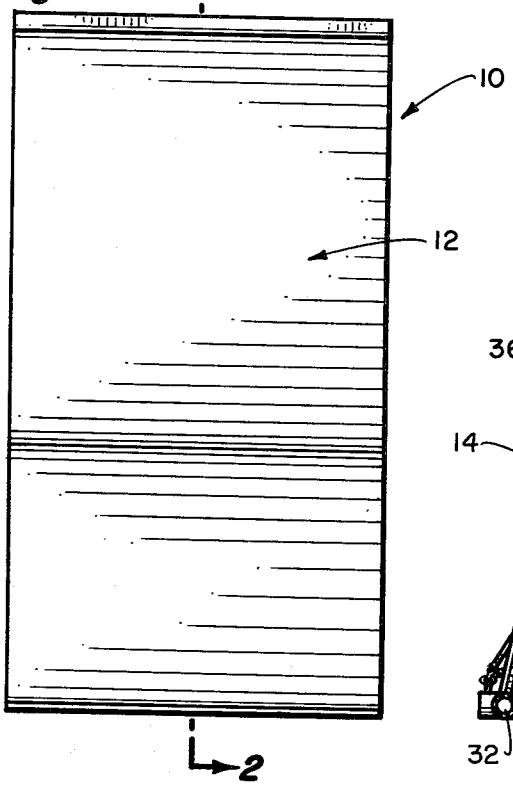
FIG. 1 is a front elevational view of a ramp constructed in accordance with the teachings of our invention.
Figure 2:
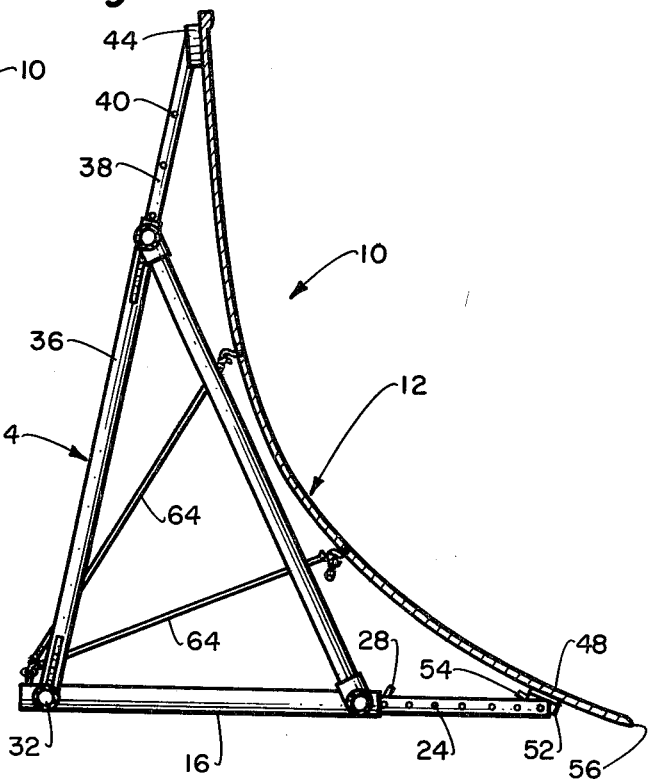
FIG. 2 is a side elevational view of the ramp of FIG. 1.
Figure 3:
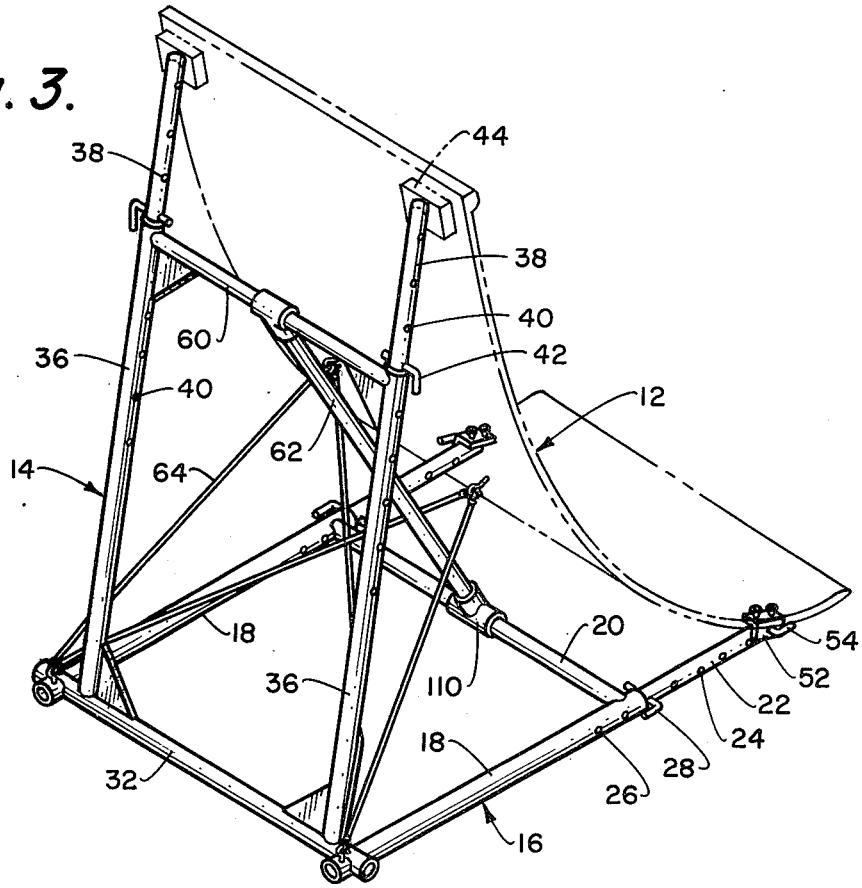
FIG. 3 is a rear, isometric view of the ramp of FIGS. 1 and 2.

Referring to the drawings, and more particularly to FIGS. 1–3 thereof, I show a ramp 10 adapted to be utilized by individuals on skateboards, roller skates and other wheeled sporting devices. The ramp 10 includes an arcuately formed ramp member 12, which may be fabricated from wood laminae or any desired material, but which is preformed into a rigid generally arcuate configuration as shown in cross-section in FIG. 2 of the drawings. The ramp member 12 is mounted on a supporting frame 14 which, again, can be fabricated from any desired material, but which, in the presently discussed embodiment, is formed from tube sections fabricated out of polyethylene plastic. Of course, it is not intended that the type of material nor the tubular configuration of the components of the supporting frame 14 limit the over-all scope of the invention since it will be obvious to those skilled in the art that a wide variety of different types of materials can be utilized with equal efficacy.

The supporting frame includes a base member 16 disposed upon a supporting surface, said base member being normally maintained in a horizontal attitude and including tubular siderails 18 having a crossbar 20 extending there between and affixed thereto at the forward extremities thereof.

Mounted in telescoping relationship with the siderails 18 are extension bars 22, which have plurality of openings 24 therein, juxtaposable to corresponding openings 26 in the siderails 18. Adjustment pins 28 are provided which permit the adjustable extensions 22 to be moved inwardly and outwardly from the siderails 18 to correspondingly reduce or elongate the base of the supporting frame 14.

A rear connecting bar 32 extends between the rearward extremities of the siderails 18 and serves to maintain them in operative relationship.

Operatively secured at their lower extremities to the rear connecting bar 32 are inclined supporting posts 36 having tubular extensions 38 telescopically associated therewith which are adjustable by the utilization of corresponding openings 40 and adjustment pins 42.

The upper extremity of the ramp member 12, which is shown in phantom in FIG. 2 of the drawings, is operatively secured to the upper extremities of the extensions 38 by connecting means, including saddle blocks 44, which permit the upper extremity of the ramp member 12 to pivot upon the upper extremities of the extensions 38 when corresponding upward or downward movement of the extensions 38 occurs to correspondingly raise or lower the upper extremity of the ramp member 12.

The lower forward extremity 48 of the ramp member 12 is pivotally connected to the forward extremity of the corresponding lower siderail extensions 22 by means of angle plates 52 and pins 54. The extreme forward extremity of the ramp member 12 is beveled, as at 56, to permit a user of the ramp to ride easily over said forward extremity.

An upper crossbar 60 extends between the upper extremities of the angularly oriented rail members 36 and has a brace member 62 pivotally mounted intermediate its extremities, the lower end of the brace member 62 being correspondingly and pivotally secured intermediate the extremities of the crossbar 20 of the base portion of the supporting frame.

Bungees or similar elastic means 64 are secured between the frame and the under side or back side of the ramp member 12 to impose a load upon the ramp member 12 and to maintain it in operative relationship with the supporting frame 16.

Thus, it can be readily ascertained that the angle of incidence of the ramp member 12 with reference to the surface upon which it is supported by the supporting frame may be altered by the extension or retraction of the horizontal and substantially vertical extensions 22 and 38, respectively. As the extensions are extended or retracted, the ramp member 12 is correspondingly pivoted freely on the pivotal connections provided by the saddles 44 on the upper extremity of the ramp member 12 and the angle plates 52 and associated pins 54.

Thus, ease of adjustment of the ramp member 12 is inherent in the operative relationship between the ramp member 12 and the supporting frame.

In addition, the adjustable nature of the supporting frame and the pivotal connection of the ramp member 12 in operative relationship therewith permits the components of the supporting frame to be readily dismounted from operative relationship with one another and from operative relationship with the ramp member 12. This permits the relatively large assemblage to be shipped in knock-down condition in a package which is relatively small, considering the overall size of the assembled unit.

Figure 4:
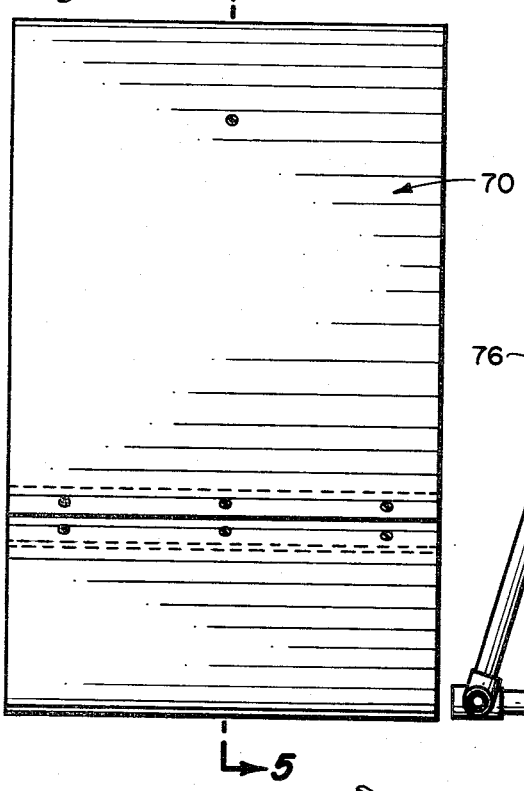
FIG. 4 is a front elevational view of an alternative embodiment of the ramp of the invention.
Figure 5:
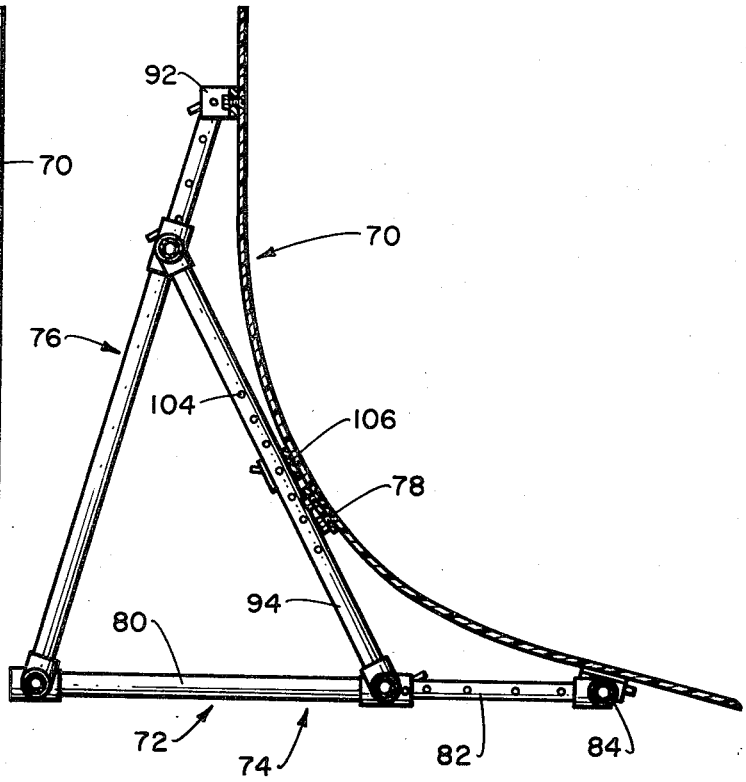
FIG. 5 is a side elevational view with the ramp member shown in cross-sections.
Figure 6:
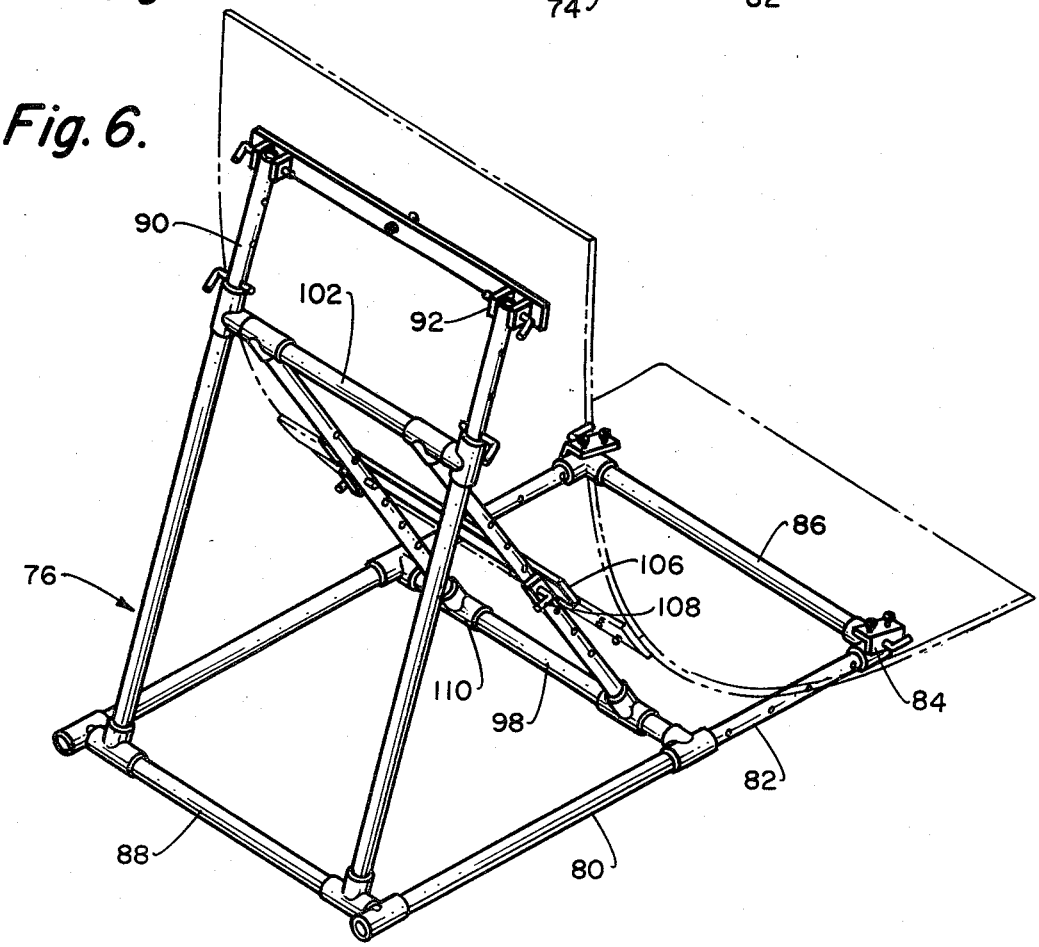
FIG. 6 is a rear, isometric view of the ramp shown in FIGS. 4 and 5.
Figure 7:
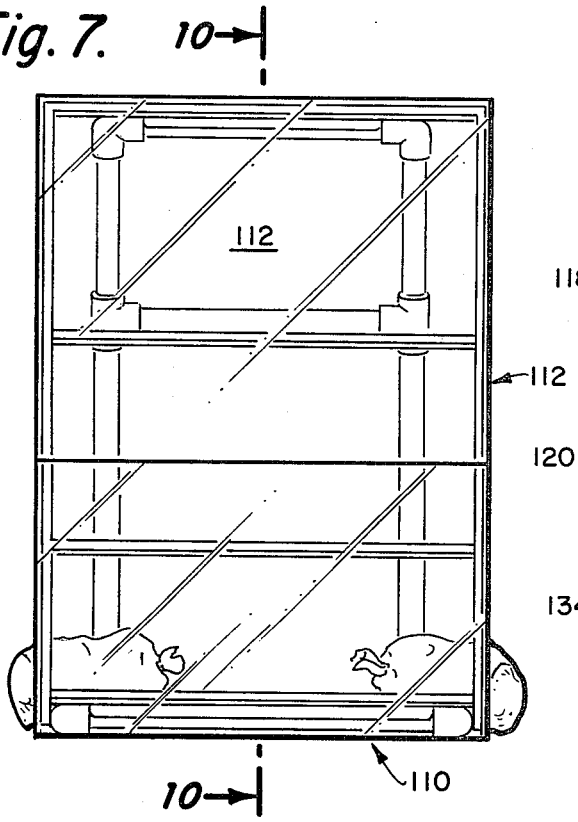
FIG. 7 is a front elevational view of an alternative form of our invention.
Figure 8:
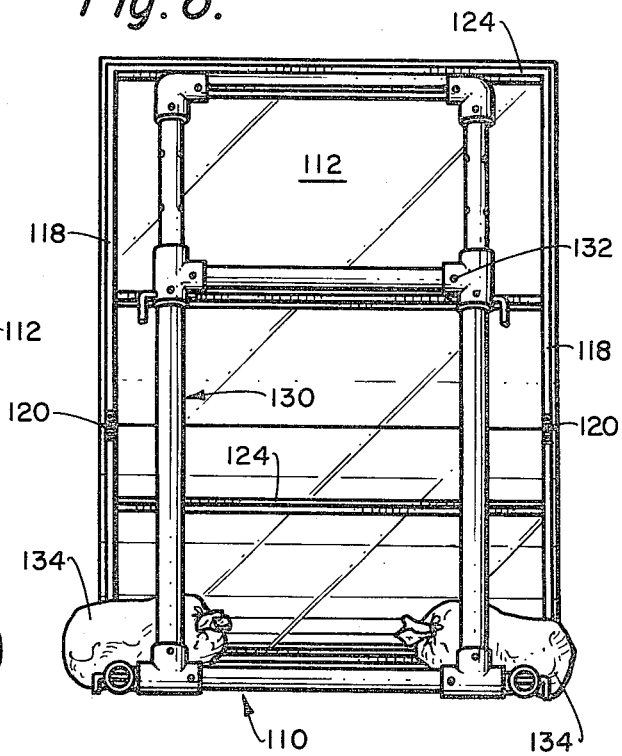
FIG. 8 is a rear, elevational view.

An alternative embodiment of the invention is shown in FIGS. 4–6 of the drawings as including a ramp member 70 formed of a transparent resilient material such as acrylic or polycarbonate. Since the ramp member 70 is incapable of maintaining the arcuate shape which is necessary for the proper utilization of the ramp, the arcuity of the ramp member 70 is imparted to it by the supporting frame 72, which includes a base 74, and an angularly oriented supporting means 76.

The ramp member 70 can be made from a single piece of material or can be fabricated from several pieces which are butted together and maintained in butted relationship by means of a securement plate 78. The base 74 is provided with siderails 80, having tubular extensions 82 to which the lower extremity of the ramp member is pivotally secured by means of metal angles 84 which are pivotally connected to the forward extremities of the extensions 82 which are connected by crossbar 86.

The angularly oriented supporting means 76 is pivotally mounted on a rear crossbar 88 and includes extensions 90, which can be raised or lowered to raise or lower the upper extremity of the ramp member 70. Pivotal connections 92 are provided to secure the upper extremity of the ramp member 70 in operative relationship with the extensions 90. A brace 94 is pivotally interconnected between a crossbar 98 on the base 74 and a crossbar 102 on the angularly oriented supporting means 76. A plurality of adjustment openings 104 is provided in the brace for mounting a movable auxiliary support 106, which is adapted to be shifted up and down the brace by means of adjustment pins 108.

Consequently, the auxiliary supporting means 106 can be shifted to locate it at the point where auxiliary support is needed for the flexible, resilient ramp member. It will be noted that the pivotal connections between the supporting frame 72 and the ramp member 70 impart the arcuate configuration to the ramp member 70. Of course, the adjustment of the extensions 82 and 90 also causes the arcuity of the ramp member and its angle of incidence to the supporting surface on which the supporting frame 72 is located to be simultaneously altered.

Once again, ease of assembly and disassembly of the components is achieved by the telescopic adjustment means of the supporting frame and demountable pivot connections of the ramp member 70 in operative relationship with the associated extensions of the supporting frame.

It will be noted that, where certain movable connections between the braces and other components of both supporting frames are provided, we have utilized tubular T members such as the T members 110 to permit the braces to be pivotally moved on the connecting bars.

Figure 12:
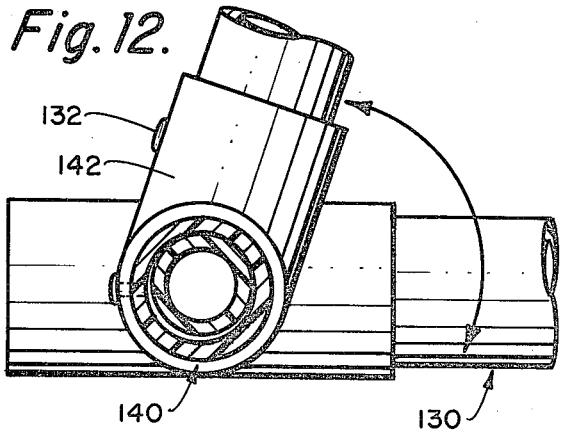
FIG. 12 is an enlarged, sectional view taken from the broken line 12 of FIG. 10.
Figure 9:
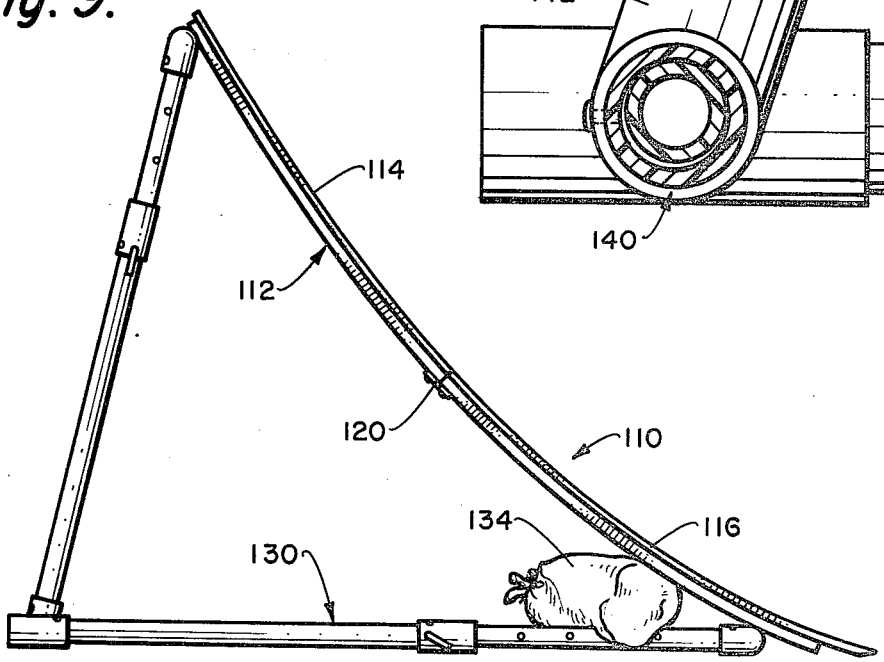
FIG. 9 is a side, elevational view.
Figure 10:
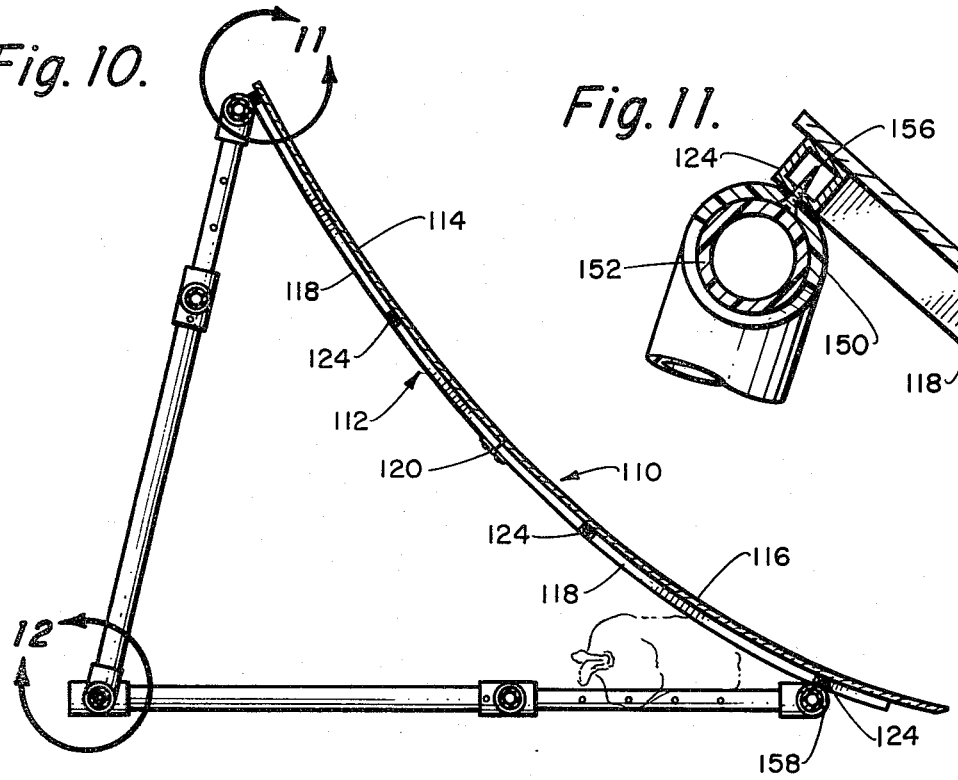
FIG. 10 is a vertical sectional view taken on the broken line 10—10 of FIG. 7.
Figure 11:
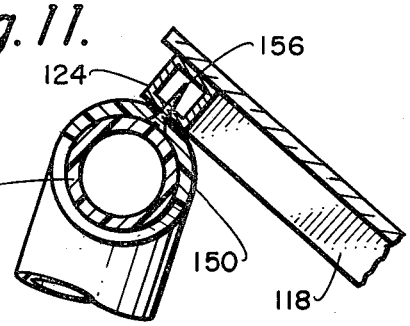
FIG. 11 is an enlarged sectional view taken from the line 11 of FIG. 10.
Figure 13:
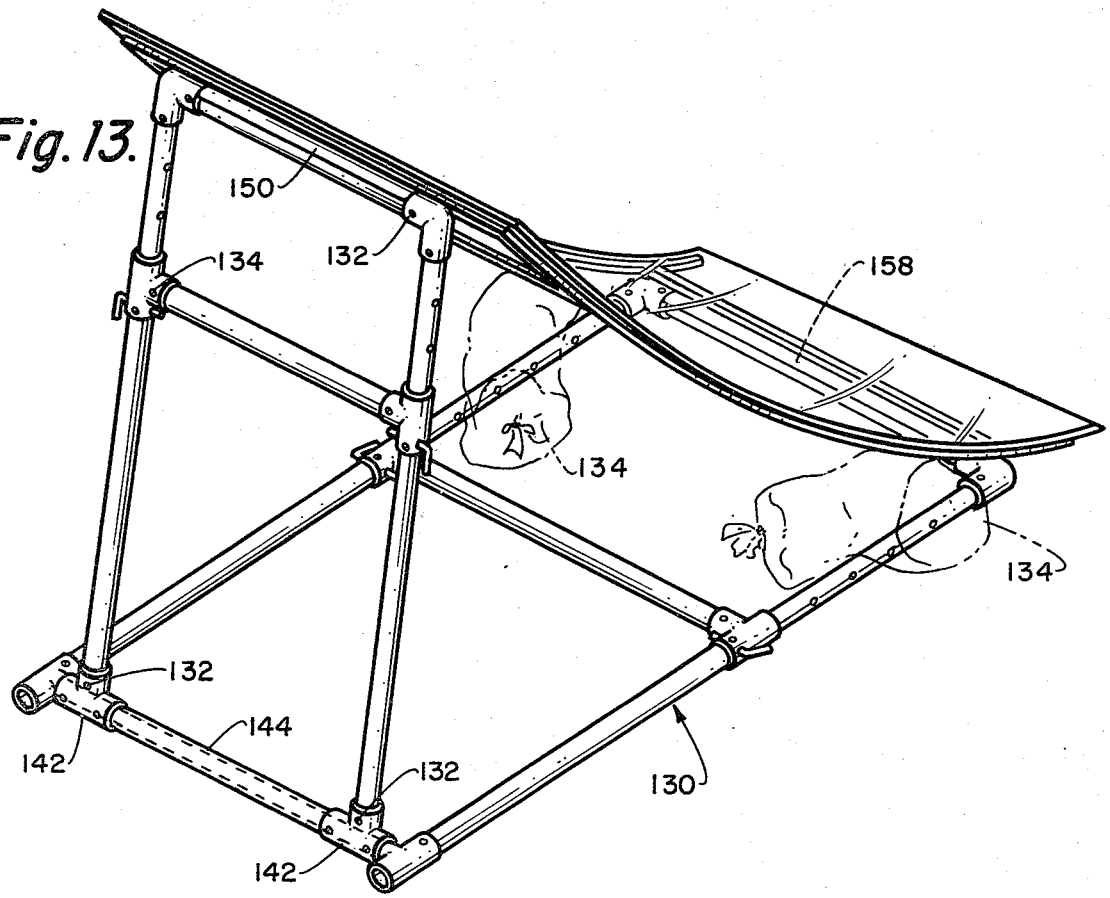
FIG. 13 is an isometric view.

An alternative embodiment of 110 of the ramp of our invention is best shown in FIGS. 10–12 as including an elongated arcuately formed ramp member 112 consisting of a pair of arcuately formed ramp panels 114 and 116, which are supported at opposite edges by curvilinear supporting or rigidifying frame members 118 formed from rectangular steel shapes or the like. The rigidifying members 118 are connected to each other by a hinge 120, as best shown in FIG. 10 of the drawings. Consequently, when the ramp member 112 is prepared for shipment, the cooperating ramp panels 114 and 116 can be folded upon one another to provide a smaller shipping package.

Spanning the rigidifying members 118 and serving to maintain the same spaced relationship, are transverse rigidifying elements 124 which may be fabricated from steel shapes of square or rectangular cross-sections. The rigidifying members 118 and elements 124 are operatively connected to one another by welding, the use of screw fasteners and the like. The respective ramp panels 114 and 116 may be connected thereto by blind rivets, screws or the like which are countersunk into the surface of the ramp panels 114 and 116 so as not to interfere with the smooth surface thereof.

A supporting frame 130 is essentially the same configuration and construction as the supporting frame 72 of the previously disclosed embodiment of the invention with the exception that safety screw fasteners 132 are provided at the various joints to insure that the various components thereof will not separate. It will be noted that sandbags or similar weights 134 are utilized in conjunction with the frame 130 to insure that the weight of an individual utilizing the ramp 110 will not cause the displacement thereof.

Shown in FIG. 12 of the drawings is a lower pivoting attachment joint 140 which includes a plastic T-joint 142 which encompasses and pivots upon a transverse spanning member 144.

The ramp member 112, as best shown in FIGS. 10 and 11 of the drawings, includes a semi-circular snap connecting means 150 which is formed from plastic material and which snaps over the spanning member 152. The snap connecting member is secured by screws 156 to the underside of the rigidifying member 124. A similar connection is provided at the forward lower extremity of the ramp member 120 as indicated at 158 at FIG. 10 of the drawings.

Consequently, the ramp member 112 can be snapped on and off the supporting frame 130 to permit the supporting frame to readily receive the ramp member 112. This also permits the ramp member 112 to be readily dismounted from operative engagement with the corresponding components of the supporting frame 112.

Figure 14:
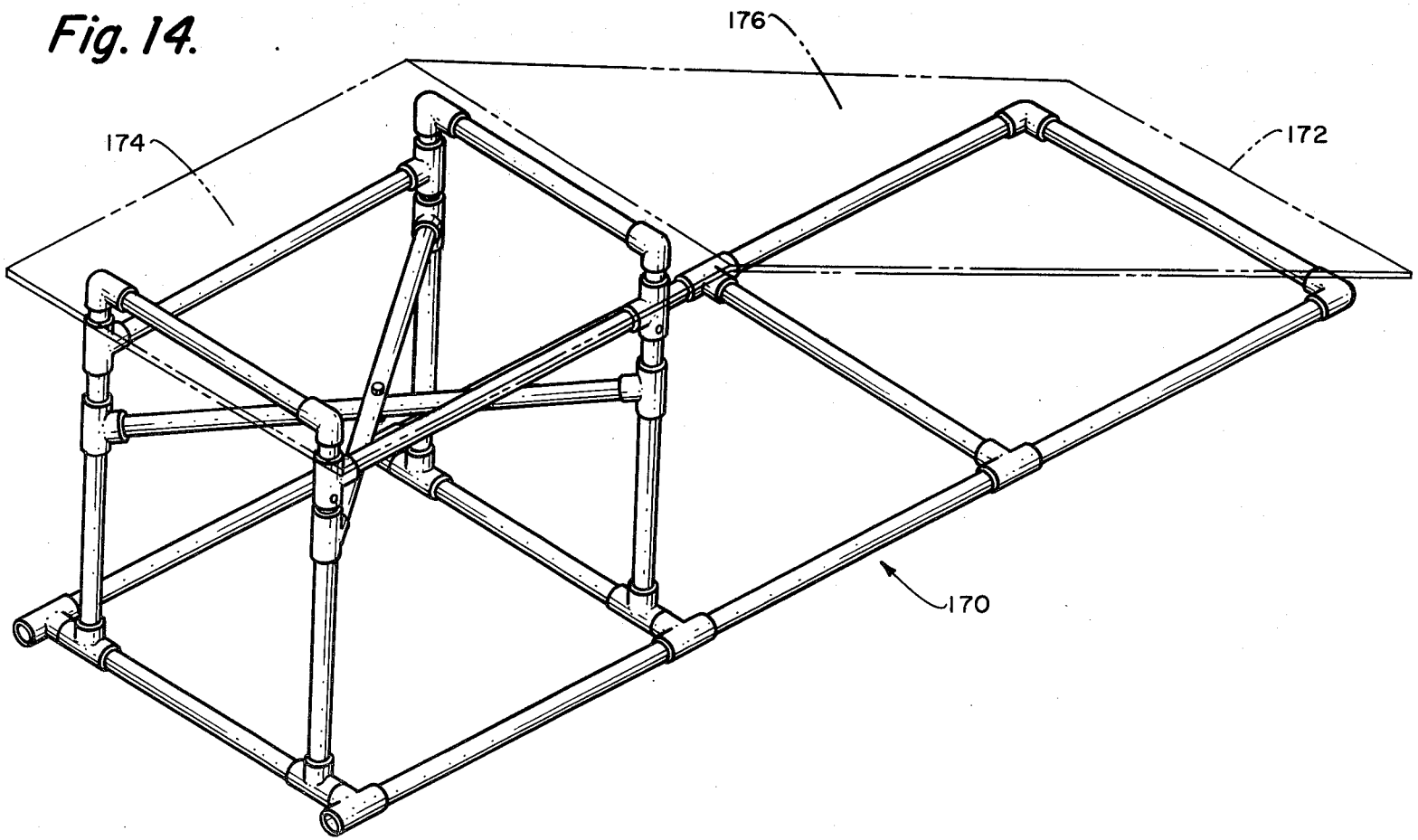
FIG. 14 is an isometric view of still another alternative form of the ramp of our invention.

Shown in FIG. 14 of the drawings is a rigid supporting frame 170 which has a ramp member 172 supported thereupon. Unlike the previous embodiments of the invention, the ramp member 172 consists of two flat ramp panels 174 and 176 which are laid in overlying relationship with corresponding elements of the supporting frame 170 and which may include snap members similar to the snap members 150 of the previously disclosed embodiment of the invention.

We claim:

1. In a ramp for use in conjunction with wheeled sporting devices, the combination of: an elongated ramp member having its lower extremity juxtaposed to a supporting surface and its upper extremity disposed above and in spaced relationship with said supporting surface; a suspensory frame for said ramp member; adjustment means on said frame for adjusting the component portions of said frame with respect to one another; and movable connections between said upper and lower extremities of said ramp member and said frame to permit the raising or lowering of said ramp member with respect to said supporting surface when the components of said frame are adjusted to accomplish said raising or lowering of said ramp member.

2. A ramp of the character defined in claim 1 in which said ramp member is curvilinear.

3. A ramp of the character defined in claim 1 in which said connections between said ramp and said suspensory frame are pivotal connections permitting the rotation of said ramp member with respect to said frame as the components of said frame are adjusted.

4. In a ramp for use in conjunction with wheeled sporting devices, the combination of: an elongated, curvilinear ramp member having its lower extremity juxtaposed to a supporting surface and its upper extremity disposable above and in spaced relationship with said supporting surface; a suspensory frame for said ramp member, said suspensory frame including a plurality of readily demountable components, said suspensory frame incorporating adjustment means for adjusting the attitude of said ramp member with respect to said supporting surface; and movable connections between said ramp member and said suspensory frame to permit the alteration of the attitude of said ramp member with the supporting surface concomitantly with the adjustment of said suspensory frame.

5. A ramp of the character defined in claim 4 in which said suspensory frame includes telescopic adjustment means for lengthening or shortening said suspensory frame to correspondingly alter the attitude of said ramp member with respect to said supporting surface.

6. A ramp of the character defined in claim 5 in which said connections are pivotal to permit rotation of said ramp member in respect to said suspensory frame during the adjustment of said frame by said telescopic adjustment.

7. In an adjustable, demountable ramp for use in conjunction with wheeled sporting devices, the combination of: an elongated resilient ramp member having a lower extremity juxtaposable to a supporting surface and an upper extremity disposable in spaced relationship with said supporting surface; a suspensory frame for the said ramp member; movable connections for connecting said resilient ramp member to said suspensory frame and for causing said ramp member to assume a flexed, resilient, curvilinear orientation on said suspensory frame; and adjustment means on said frame for altering the spatial relationships of components of said frame to cause the raising or lowering of said upper extremity of said ramp member.

8. A ramp of the character defined in claim 7 in which an auxiliary support is interposed between the underside of said ramp member and said suspensory frame to limit the flexing of said ramp member.

9. A ramp of the character defined in claim 8 in which said auxiliary support is moveable to accommodate variations in the curvature of said ramp member attributable to the aforesaid adjustment of said suspensory frame.

10. In an adjustable, demountable ramp for use in conjunction with wheeled sporting devices, the combination of: an elongated resilient ramp member having its lower extremity juxtaposable to a supporting surface and its upper extremity disposable in spaced relationship with respect to said supporting surface; a suspensory frame for said ramp member, said suspensory frame including adjustment means to permit adjustment thereof and corresponding adjustment of said ramp member; and movable connections between said frame and said ramp member whereby said frame maintains said ramp member in a flexed, curvilinear position on said frame and whereby adjustment of said frame causes the elevation of the upper extremity of said ramp member to change the angle of incidence of said ramp member and its curvilinear aspect with respect to said frame and said supporting surface.

11. A ramp of the character defined in claim 1 in which said connections between said ramp and said suspensory frame are pivotal connections permitting the rotation of said ramp member with respect to said frame as the components of said frame are adjusted and said pivotal connections can be snapped on and off said frame.

* * * * *